United States Patent [19]

Beck

[11] Patent Number: 4,506,842

[45] Date of Patent: Mar. 26, 1985

[54] DEVICE FOR SPLICING A MOVING WEB TO A WEB OF A NEW ROLL

[75] Inventor: Heinrich Beck, Bussigny, Switzerland

[73] Assignee: Bobst SA, Lausanne, Switzerland

[21] Appl. No.: 541,057

[22] Filed: Oct. 12, 1983

[30] Foreign Application Priority Data

Nov. 1, 1982 [CH] Switzerland ..... 6341/82

[51] Int. Cl.[3] ..... B65H 19/10

[52] U.S. Cl. ..... 242/58.3

[58] Field of Search ..... 242/58.3, 58.2, 58.1, 242/58.4; 474/205

[56] References Cited

U.S. PATENT DOCUMENTS

| | | | |
|---|---|---|---|
| 3,195,827 | 7/1965 | Schowerer et al. | 242/58.3 |
| 3,622,097 | 11/1971 | Maas | 242/58.4 |
| 3,738,187 | 6/1973 | Hisserich | 474/205 |
| 3,944,151 | 3/1976 | Lee et al. | 242/58.3 |
| 3,977,618 | 8/1976 | Kato et al. | 242/58.3 |
| 4,171,780 | 10/1979 | Bugnone | 242/56.2 X |

*Primary Examiner*—Stuart S. Levy
*Assistant Examiner*—Leo J. Peters
*Attorney, Agent, or Firm*—Hill, Van Santen, Steadman & Simpson

[57] ABSTRACT

A device forms a splice between a moving web of a terminating roll and a web of a new roll in either one of two positions. The device has a pressure arm assembly, which has a pressure roll and a cutting device for severing the moving web from the terminating roll after formation of the splice and an acceleration arm assembly which has an acceleration roller and a motor for driving the roller with one of the two assemblies being constructed so that it can pass through an opening in the other assembly to shift the two assemblies from an "IN" splicing position, wherein the new roll is rotated in a clockwise direction to a "OUT" splicing position wherein the new roll is rotated in a counterclockwise position.

9 Claims, 5 Drawing Figures

DEVICE FOR SPLICING A MOVING WEB TO A WEB OF A NEW ROLL

BACKGROUND OF THE INVENTION

The present invention is directed to a device for forming a splice between a moving web from a finishing or terminating roll of material which web is being delivered to a processing machine and an overlapping portion of a new web from a new roll of web material. The device forms the splice between the two portions of the web as the terminating or finishing roll is almost completely used.

The splicing operation such as a lap splicing operation is well known by users of printing, cutting and embossing machines for paper or cardboard. The complete roll and the unwinding roll are placed on a roll support which has arms that can turn around a central axle. The web material unwinding from the roll is delivered at a very high speed and in a continuous mode to a processing machine. In order to avoid any damage to the production, the finishing or terminating roll is replaced during the running of the machine. For this operation, a new roll is brought into rotation so that its circumferential speed is equivalent to the linear speed of the unwinding or moving web delivered by the expiring roll. To bring the new roll to this speed, the device will have means for accelerating which may be either rollers or belts and the means for accelerating will start as soon as the splicing order is given either by an operator or automatically according to the quantity of web remaining on the terminating or finishing roll. The linear speed of both webs is adjusted and the splicing area previously prepared on the new roll is detected. The splicing on the new roll generally comprises pre-glued or self-adhesive faces which allow the gluing of the overlapping portions of the moving web from the finishing roll with a starting portion of the new web of the new roll. As soon as the splicing area is detected and a signal created, a pressure roller over which the moving web from the finishing or terminating roll is passing is pressed against the circumference of the new roll. A transversal cutting device is arranged next to the pressure roll and is actuated as soon as the splicing has been accomplished. The transversal cutting device will cut the moving web which was unwinding from the finishing roll and then moves back to a retracted position. Thus, the web, which is being delivered from the new roll, will necessarily run along the previous path of the web from the finishing roll. Of course, this type of splicing of two rolls will cause a loss at the splicing spot. The dimensions of this loss can vary with regard to the running speed of the web and the time needed by the device to react after receiving the splicing signals. Such a splicing device is described in U.S. Pat. No. 3,195,827, whose disclosure is incorporated by reference thereto.

If the processing machine is a printing press, it might happen that it will use a web, which is partially preprinted. The roll can be wound with the printed surface or face inside, i.e., turned toward the axle or core of the roll or its printed face turned outside. It also can occur that due to the manufacturing process of the roll, the "good face" of the web can be turned either inside or outside on the wound roll. Thus, the roll must be completely unwindable in one sense or the other according to the request.

A device allowing this kind of splicing is circumstantially described in U.S. Pat. No. 3,622,097. This patent refers to an end-to-end splicing of the web delivered by the finishing or terminating roll and the web of the new roll. This method requires a slightly different processing in the splicing area of the new roll.

Both of the above-mentioned devices have some drawbacks. With the location of the accelerating and pressure elements described in the U.S. Pat. No. 3,195,827, the unwinding sense of the new roll cannot be reversed. The device which is mentioned in the U.S. Pat. No. 3,622,097 allows a change of the rotation direction for the new roll but uses two different elements for this purpose. Moreover, the lap is not pressed directly against the new roll but maintained between these elements. It is also noted that this patent refers to an end-to-end splicing of the web delivered by the finishing or terminating roll which end-to-end splicing is performed with the help of a blade previously inserted in the splicing area prepared on the new roll.

SUMMARY OF THE INVENTION

The present invention is directed to a device for forming a splice between a moving web from a finishing roll of material being delivered to a processing machine and an overlapping portion of a new web from a new roll of web material, which device avoids the above-mentioned problems. In addition, the device can achieve the splicing on one face of the new web being delivered from the new roll or on the opposite face while using only a single splicing element or arrangement.

To accomplish these objects, the present invention is directed to an improvement in a device for forming a splice between a moving web for a finishing roll of material being delivered to a processing machine and overlapping portion of the new web from a new roll of web material. The device comprises acceleration means to adjust the circumferential speed of the new roll to the linear speed of the moving web of the finishing roll; detecting means for detecting an overlapping splicing area previously prepared on the new roll; pressure means for pressing the moving web against the outer surface of the new roll when the splicing area on the outer surface of the new roll passes by the pressure means; and cutting means for cutting the moving web being unwound from the finishing roll after formation of the splice with the new web. The improvements comprise a support having a pair of spaced side members, a pair of tubular housings being keyed to a first axle and being mounted for rotation in said side members with each housing extending past both surfaces of its side member, a first idler roller mounted for rotation on said first axle between the side members; said acceleration means including an acceleration arm assembly having a frame with one end being mounted for rotation on the pair of tubular housings between the side members of the support and having a second transverse axle at the other end, a subassembly being mounted at one end for pivotal movement on said second axle and having a roller axle with an acceleration roller at the opposite end, means for rotating the subassembly on said second axle, means disposed on the frame for rotating the acceleration roller and means for rotating the acceleration arm assembly on the first axle; said pressure means including a pressure arm assembly having a second frame having one end rigidly connected to said pair of housings on the outside of the side members to rotate with the housings, said second frame supporting a third axle and a fourth axle with the fourth axle being at the end and the third axle spaced inward, both of said axles extending across said second frame, a pair of short levers pivotally mounted on the third axle and rotatably supporting a pressure roll at one end, means for rotating the short lever arms on the third axle, means connected to the first axle for rotating the tubular housings in the side members with the second frame moving therewith, and a tension roller being rotatably mounted on the fourth axle; and said cutting means including two knives mounted on a blade support, said blade support being mounted for pivotal movement on said fourth axle, means connected to the blade support and the second frame for rotating said cutting means therein.

The improvements enable utilizing the single acceleration assembly and a single pressure arm assembly to rotate the new roll in either a clockwise or counterclockwise direction as desired. The relationship between the acceleration arm assembly and the pressure arm assembly are such that they can be rotated relative to each other with the acceleration arm assembly passing through a space in the pressure arm assembly.

DESCRIPTION OF THE PREFERRED EMBODIMENTS

Figure 1:
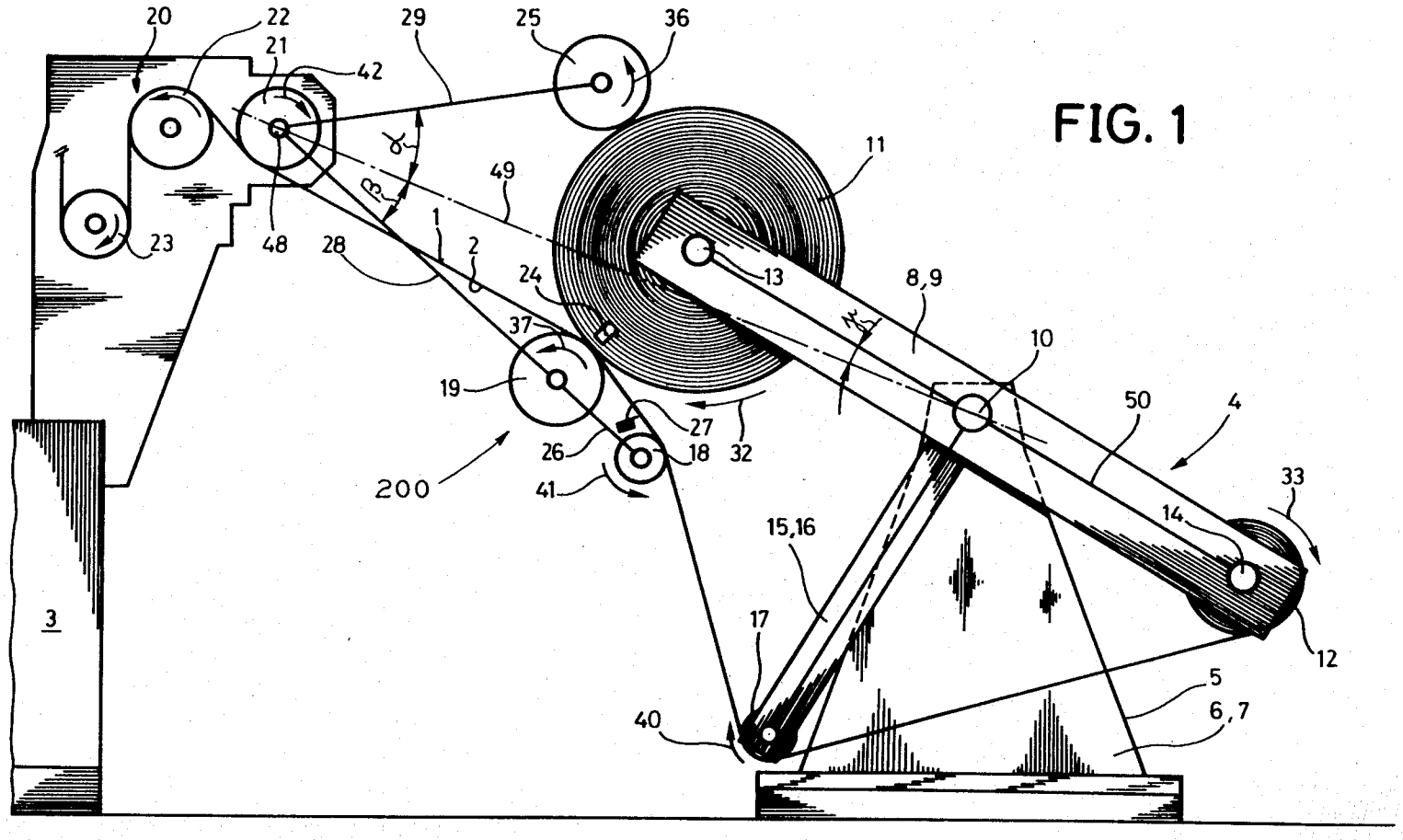
FIG. 1 schematically shows the disposition of the device according to the present invention for an "IN" splice.

The principles of the present invention are particularly useful in a splicing device generally indicated at 200 in the drawings with the arrangement schematically illustrated in FIG. 1 being for an "IN" splicing mode for splicing and introducing a web into a processing machine 3 with an inner face 1 of a web 2 turned upward.

The device 200 comprises a roll support generally indicated at 4, which is composed of a frame 5 having two side cheeks or members 6 and 7. Two arms 8 and 9 are mounted on a shaft 10 extending between the side cheeks. A new roll 11 and a finishing or terminating roll 12 are located between the arms 8 and 9 and are supported by shafts 13 and 14 respectively. The arms 8 and 9 are both provided with extensions 15 and 16 which position an idler roll 17. The arms 8 and 9 are arranged so that they can pivot on request around the transverse shaft 10. For the operating conditions shown in FIG. 1, the web 2 is delivered to a machine 3 from the terminating roll 12. The moving web 2 runs over the idler 17 to a tension roller 18 and then over a pressure roller 19. After passing over the pressure roller 19, the moving web is received by a tensioning device 20 which has idler rollers 21 and 22 and a sliding or adjustable roller 23. From the tensioning device 20, the moving web enters the processing machine 3.

When the finishing or terminating roll 12 is almost coming to an end, the web 2 is spliced to a new web from a new roll 11 to make sure that the web delivery is not interrupted. To perform this, the new roll 11 is driven by an acceleration roller 25 until it reaches a circumferential speed almost equivalent to the linear speed of the moving web 2. The splicing area, which was previously prepared on a new roll 11, has its location indicated by a reflecting plate 24, which is stuck to the roll 11. The splicing order is given either manually or automatically. To automatically give the order, a reading head (not illustrated) detects the passage or movement of the reflecting plate 24 and actuates the device which moves the pressure roller 19 to touch the circumference of the new roll 11. Simultaneously, the cutting arm 26 which supports the tension roller or roll 18 and a knife 27 will be actuated and will thus cut the web coming from the finishing roll 12. As soon as the splice is achieved, the pressure arm 28 and the accelerating arm 29 are retracted from engagement with the new roll 11. The finishing roll 12 is then removed and replaced by a new roll so that the device is prepared for the next splicing operation.

Figure 2:
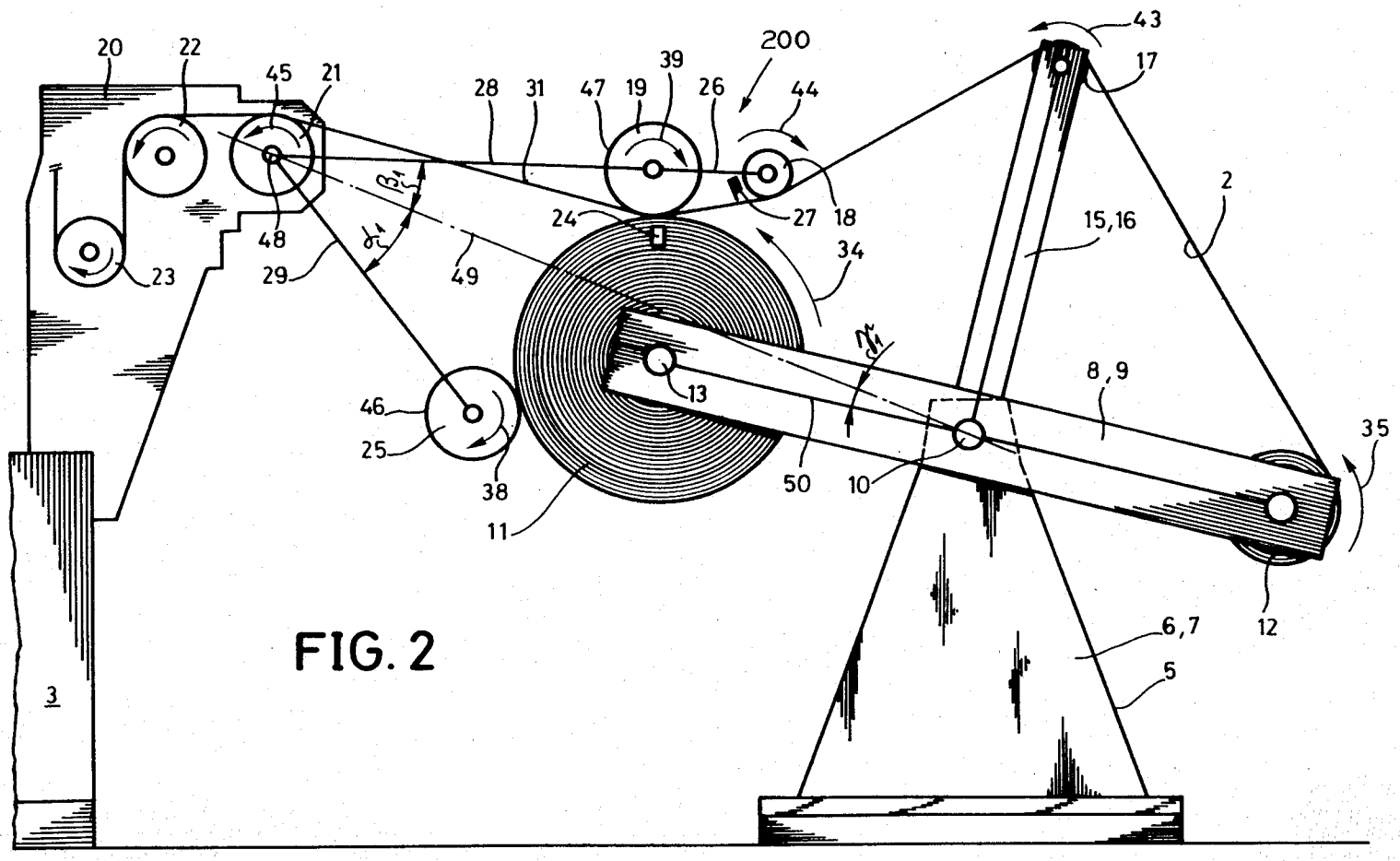
FIG. 2 schematically illustrates the arrangement of the device of the present invention for an "OUT" splice.

In the arrangement illustrated in FIG. 2, the device 200 has been arranged for an "OUT" splicing, for example, with the splicing being achieved with the moving web being introduced into the machine 3 with its external face 31 turned upward. The device shown in this Figure is similar to the one in FIG. 1 and made with the same components. But for the "OUT" splicing, the rotation direction of the various rolls and rollers is reversed from that of FIG. 1. Thus, the new roll or reel 11 and the finishing roll or reel 12 of FIG. 1 both move in a clockwise direction as indicated by the arrows 32 and 33 along with the idler roller 17, which moves in a clockwise direction indicated by the arrow 40, and the idler roller 21, which moves in a clockwise direction indicated by the arrow 42. In order to obtain this movement for the device of FIG. 1, the acceleration roller 25 moves in a counterclockwise direction indicated by the arrow 36 and the pessure roller 19 moves in a counterclockwise direction indicated by the arrow 37. In addition, the tension roller 18 moves in the same direction as indicated by the arrow 41. In the arrangement for FIG. 2 which is the "OUT" splicing arrangement or mode, both the new roll 11 and the finishing roll 12 move in a counterclockwise direction as indicated by the arrows 34 and 35. Also, the idler rollers 17 and 21 move in a counter-clockwise direction as indicated by the arrows 43 and 45, respectively. To obtain this movement, the acceleration roller 25 moves in a clockwise direction indicated by the arrow 38 and the pressure roller 19 and tension roller 18 move in a clockwise direction as indicated by the arrows 39 and 44, respectively.

As illustrated, the acceleration arm 29 and the pressure arm 28 in the arrangement in FIG. 2 have been shifted from the initial position illustrated in FIG. 1 to a second position such as 46 and 47 of FIG. 2. This shifting will cause the crossing of the acceleration arm 29 and the pressure arm 28 around their common pivot point or line 48. The pivot point 48 is provided by an axle 56 (FIG. 3) of the idler roller 21. A line 49, which is drawn from the pivot point 48 to a theoretical center of the transverse shaft 10, constitutes the symmetry axis of the device. When an "IN" splicing mode is achieved as illustrated in FIG. 1, the line 49 cuts the axis of the arms 8 and 9 with an angle $\gamma$ and with an "OUT" splicing mode as illustrated in FIG. 2, it forms an angle $\gamma_1$. The angle $\gamma$ is equal to the angle $\gamma_1$ and this allows for both "IN" and "OUT" splicing modes. When the arrangement is in the "IN" splicing condition or mode of FIG. 1, the arm 28 forms an angle $\beta$ with the line 49 and the arm 29 forms angle $\alpha$. However, when the arms are switched to the "OUT" position or mode, the arm 28 will form an angle $\beta_1$ and the arm 29 will form an angle $\alpha_1$. As with regard to the previously mentioned angles, the angle $\alpha_1$ equals the angle $\alpha$ while the angle $\beta_1$ equals the angle $\beta$.

In order to enable the pressure arm assembly 28 and the acceleration arm assembly 29 to shift places as illustrated diagrammatically in FIGS. 1 and 2, they are each mounted to pivot around a common axle 56 (FIG. 3) which forms the pivot point or line 48 in FIGS. 1 and 2. The pressure arm assembly 28 is made of a frame which is composed of two splicer arms or levers 53 and 54. The splicer arm or lever 53 is secured on a tubular housing 55 which is mounted at the end of the axle 56 (see FIG. 4). The rotation of the axle 56 is transferred to the housing 55 by a key 57. The housing 55 is mounted for rotation in a side frame member 201 of the tensioning control device 20 by a bearing such as a roller bearing 51. The axle 56 rotatably supports the free-turning idler roller or roll 21, which is mounted on the axle by ball bearings such as 58. The end of the other splicer arm or lever 54 is mounted on a tubular housing 59 which is mounted by a bearing 52 in another side frame member 202 of the tension controlling device 20. As illustrated, the splicer levers 53 and 54 are on the outside of the frame members 201 and 202. The end of the axle 56 which extends past the frame member 202 is engaged with a reduction motor 60, which is secured on a face 61 of the frame member 202. Thus, the motor 60, when actuated, will pivot the two levers 53 and 54 around the axle 56 and move them between the "IN" position and the "OUT" position.

The frame formed by the splicer levers or arms 53 and 54 includes a cross-bar 62, which is secured to each of the arms 53 and 54 such as by having an end secured to an inner face 63 of the arm 53 by screws 64. Outward of the cross-bar 62, an axle 65, which rotatably supports the tension roller 18, is provided. The axle 65 also constitutes the rotational point of a cutting device 66 of the cutting means 27. The cutting device 66 has two pivoting levers 67 and 68 which are interconnected by a pair of knife carriers 69 and 70. The knife carriers 69 and 70 carry the two knives 71 and 72. The knife 71 (FIG. 3) is used for an "IN" splicing while the knife 72 is used for an "OUT" splicing. The lever 67 has an extension or arm 73 on which an end 74 of a rod 75 for a pneumatic piston 76 is secured. The pneumatic piston 76 is pivotally mounted on a stirrup or arm 77 of a splicing lever 53.

Figure 3:
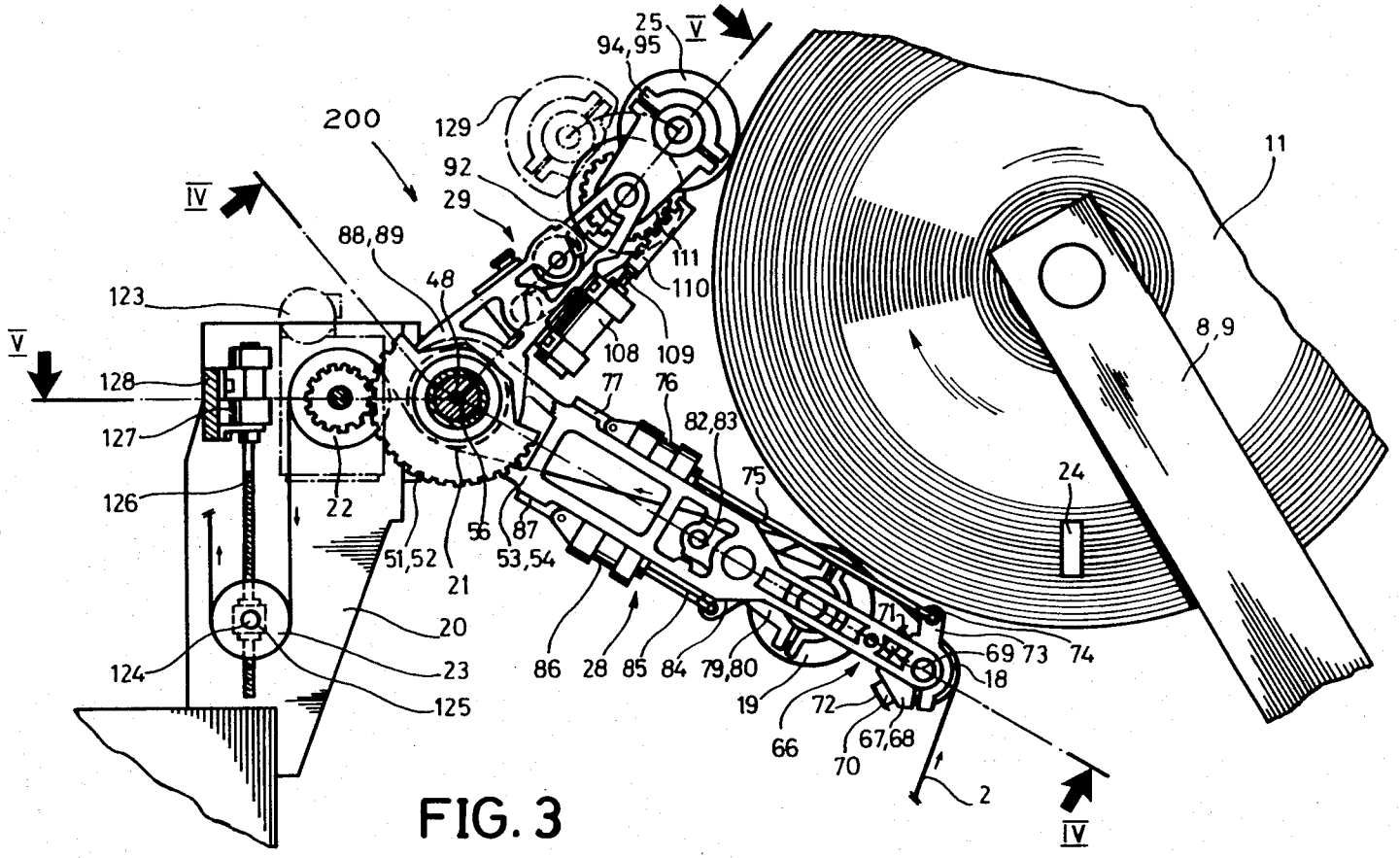
FIG. 3 is a side view with portions broken away for purposes of illustration of the device of the present invention.
Figure 4:
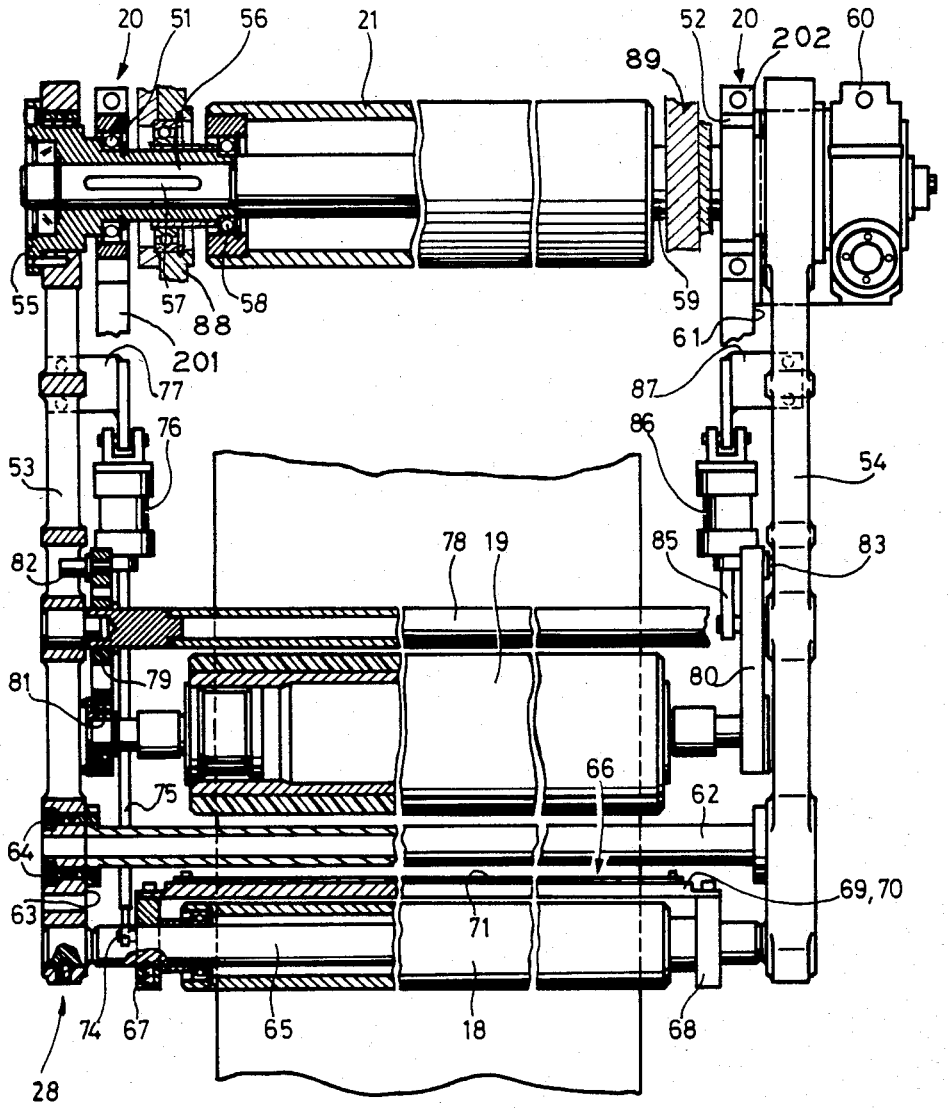
FIG. 4 is a view generally taken along the line IV—IV of FIG. 3 with portions broken away for purposes of illustration.

In addition to being interconnected by the support or cross-bar 62 (FIG. 4) and the axle 65, the frame also has a transverse axle 78 which extends between the two splicer arms 53 and 54. The transverse axle 78 provides a pivot point for two short levers 79 and 80, which form a subframe and at one end support the axle of a pressure lever 19 for rotation, which axle is mounted in a bearing 81. At the opposite end, each of the short leves 79 and 80 are provided with studs 82 and 83, respectively, which limit the angular path of the pivotal movement of the short levers 79 and 80. In order to move the short levers, a pneumatic piston 86 is pivotally mounted on an extension or plate 87 of the splicer arm 54. The piston 86 has a piston rod 85, which is pivotally connected to a bracket 84 on the short lever 80 (FIG. 3).

Figure 5:
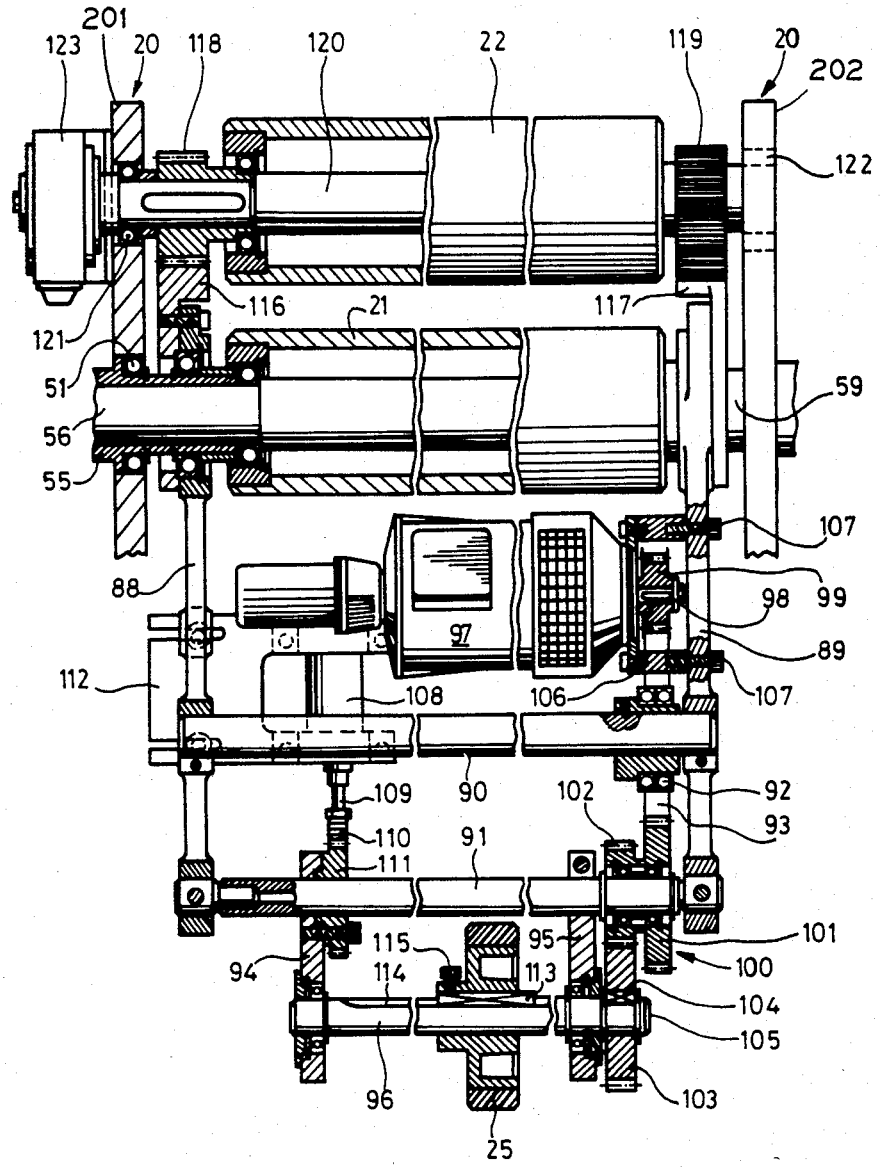
FIG. 5 is a view generally taken along the line V—V of FIG. 3 with portions broken away for purposes of illustration.

The acceleration arm assembly 29 has a frame which is composed of two lateral levers or side elements 88 and 89, which as best illustrated in FIG. 5 are mounted for rotation on the housings 55 and 59, respectively. It should also be noted that these side elements 88 and 89 are mounted inside of the frame members 201 and 202. To complete the frame formed by the side elements 88 and 89, they are interconnected by a transverse axle 90 and a transverse axle 91 which transverse axle 91 is at the end of the two arms 88 and 89. The transverse axle 90 rotatably supports an idler roll 92 which is used for tensioning a tooth belt 93 of means for driving an acceleration roll 25. This means will be discussed in greater detail hereinafter. The transverse axle 91 provides a pivot point for a subassembly comprising a second pair of arms 94 and 95 which are mounted for pivotal rotation on the axle 91. The second pair of arms 94 and 95 rotatably support an axle 96 which is keyed by a key 113 to the acceleration roll 25. To enable shifting of the acceleration roll 25 axially along the axle 96, the key 113 is in a longitudinally extending groove 114 and can be tightened in a desired axial position by an adjustment means such as a screw 115.

To drive the acceleration roll 25, drive means comprises a motor 97 with a drive shaft 98 which is provided with a toothed pulley 99. The motor is mounted by mounting members 106 and screws 107 to the side element 89. The toothed pulley 99 engages the tooth belt 93 which passes over the tensioning roller 92 to a tooth pulley 101 which is part of element 100 rotatably received on the axle 91. The element 100 also has a portion forming a pinion gear 102 which engages a pinion gear 103 keyed by a key 104 to an end 105 of the axle 96. As mentioned, the subassembly formed by the second pair of arms 94 and 95 pivots on the axle 91 from the position illustrated in FIG. 3 to a broken line position 129. This is accomplished by means which include a pneumatic piston 108 with a piston rod 109 which terminates in a rack gear 110. The rack gear engages a pinion 111 which is secured to the arm 94 as illustrated in FIG. 5. The piston 108 is secured on a plate 112 which is mounted to one of the side elements such as 88.

The side element 88 at the end mounted for rotation on the tubular housing 55 is provided with a tooth sector portion 116. In a similar manner, the side element 89 at the end mounted on the housing 59 is provided with a tooth sector 117. The tooth sector 116 engages a pinion gear 118 which is keyed to an axle 120 and the tooth sector 117 is in meshing relationship with a pinion 119 which is also keyed to the axle 120. The axle 120 is mounted for rotational movement in the side members 201 and 202 of the tensioning device 20 by roller bearings such as 121 and 122. The shaft 120 as illustrated supports the idler roller 22 which is mounted by bearings for rotation thereon. In order to rotate the shaft 120, a reduction motor 123 is secured on a face of the side member 201 and can rotate the axle 120 and the two gears 118 and 119.

As best illustrated in FIG. 3, the tension controlling device 20 also includes the idler roller 23, which is mounted on an axle 124. The axle 124 at each end is provided with a nut 125 which is threadably received on an adjustment screw 126 which is rotated by a motor 127. The motor 127 is mounted on a cross-bar 128 which interconnects the two side frame members 201 and 202. As mentioned, the arrangement illustrated in FIG. 3 is in the "IN" splicing position.

To bring the new roll 11 to the desired circumferential speed, so that it is matched to the linear speed of the web 2 leaving the terminating or finishing roll 12, the pneumatic piston 108 is actuated so that the acceleration roller 25 is held or pressed against the circumference of the new roll 11. At this very moment, the motor 97 is started until its speed corresponds to the desired speed which is determined by the linear speed of the web 2 delivered from the finishing roll 12. A detector then detects the position of the previously prepared splicing area on the new roll 11 by detecting the position of the reflecting plate 24. The pneumatic piston 86 is then actuated to cause the roll 19 to press the web material 2 against the circumference of the roll 11. After forming the splicing lap with the new roll 11 in the vicinity of the pressure roll 19, the pneumatic piston 76 is actuated to cause the knife 71 to move in a clockwise direction to cut the web 2 which is coming from the finishing roll 12 as soon as the overlapping portions are secured together to form the splice. At the completion of cutting the web 2, the pneumatic piston 108 is again actuated to lift the acceleration roll 25 from engagement with the roll 11 and the motor 97 is stopped so that the web from the new roll 11 is being supplied to the tension control device 20 and the following processing machine.

When changing the device to an "OUT" splicing mode instead of an "IN" splicing mode, the arms 8 and 9 of the roll support 4 are shifted so that no roll comes near the splicing elements. The pneumatic piston 108 is actuated so that the acceleration roll 25 is shifted to the retracted position 129. Then the reduction motors 60 and 120 are started so that the pressure arm assembly 28 crosses with the acceleration arm assembly 29 which occurs with the acceleration arm assembly 29 passing through the opening in the pressure arm assembly 28 which is defined by the space between the axle 78 and the tubular housings such as 55 and 59. With the crossing of the two arm assemblies, they will assume the position illustrated in FIG. 2. After this changing, the arms 8 and 9 of the roll support 4 are switched to the position of FIG. 2. Thus, the web 2 from the roll furnishing the web will take the path illustrated in FIG. 2 while the new roll 11 is in the position as illustrated. It should be noted that the operation of the various elements of the splicing device 200 can be controlled either manually or automatically. It is noted that the automatic control of these elements is known in the art.

The device 200 has the advantage of allowing the use of the same methods and elements for either mode. Thus, it simplifies the use and cost. Moreover, the tensioning control device 20 enables proper control of the running condition for the web 2 as it goes to the processing machine 3.

Although various minor modifications may be suggested by those versed in the art, it should be understood that I wish to embody within the scope of the patent granted hereon, all such modifications as reasonably and properly come within the scope of my contribution to the art.

I claim:

1. In a device for forming a splice between a moving web from a finishing roll of material being delivered to a processing machine and an overlapping portion of a new web from a new roll of web material, said device comprising acceleration means to adjust the circumferential speed of the new roll to the linear speed of the moving web of the finishing roll; detection means for detecting an overlapping splicing area previously prepared on the new roll; pressure means for pressing the moving web against the outer surface of the new roll when the splicing area on the outer surface of the new roll passes by the pressure means; and cutting means for cutting the moving web being unwound from the finishing roll after formation of the splice with the new web of the new roll, the improvements comprising a support having a pair of spaced side members, a pair of tubular housings being keyed to a first axle, said housings being mounted for rotation in said side members with each housing extending past both surfaces of the side member, a first idler roller being mounted for rotation on said first axle betwen the side members; said acceleration means including an acceleration arm assembly having a pair of side elements interconnected at one end by a second axle extending transverse to said elements, said elements being mounted for rotation on the pair of tubular housings between the side members of the support, a subassembly including a second pair of arms mounted for pivotal movement on said second axle and having a roller axle at the opposite end, an acceleration roller keyed to the roller axle by axially adjustable means, means for rotating the subassembly on said second axle including a first pneumatic piston attached to the arm assembly having a rack engaging a pionion secured to one of the arms of the subframe, means disposed on the assembly for rotating the acceleration roll and means for rotating the acceleration arm assembly on said first axle including tooth sectors connected to each of the pair of side elements, said tooth sectors engaging pinions keyed on a drive shaft connected to a reduction motor connected to one of the side members of the support, said drive shaft rotatably supporting a second idler roller; said pressure means including a pressure arm assembly including a pair of splicer arms rigidly mounted on the pair of housings outside of the side members, a third axle and a fourth axle extending between and transverse to said splicer arms with the fourth axle being at the ends of said splicer arm and the third axle being spaced inward of the fourth axle, a pair of short levers pivotably mounted on the third axle and rotatably supporting a pressure roller at one end, means for rotating the short lever arms including an actuator connected between one of the short lever arms and a splicer arm, a second reduction motor connected to the first axle for rotating the tubular housings in the side members with the pressure arm assembly moving therewith and a tension roller being supported for rotation on said fourth axle; and said cutter means including two knives mounted on a blade support, said blade support being mounted for pivotal movement on said fourth axle and having an arm, and a second pneumatic piston disposed between the arm and one of the splicer arms for pivoting said blade support.

2. In a device according to claim 1, wherein the means for rotating the acceleration roller includes a motor having a drive shaft supporting a first tooth pulley being mounted on one of the pair of side frame elements, a second tooth pulley connected to a first pinion gear, said first pinion gear being in meshed relationship with a second pinion gear keyed to said roller axle, and a tooth belt extending between the first and second pulleys.

3. In a device according to claim 1, wherein the first pneumatic piston has a position for moving the subassembly to a retracted position which enables movement of the acceleration arm assembly through a frame formed by the pressure arm assembly when shifting between an "IN" splicing mode and "OUT" splicing mode and a second position with the pressure roller engaging the new roll.

4. In a device according to claim 1, wherein each of the reduction motors can be operated individually.

5. In a device according to claim 1, wherein with the pressure arm assembly and the acceleration arm assembly arranged for an "IN" splicing mode, said arms form the angles $\alpha$ and $\beta$ with a line extending through the first axle and a shaft of a roll support, said rolls being rotated about said shaft, and with the pressure arm assembly and the acceleration arm assembly in an "OUT" splicing mode, said arms form angles $\alpha_1$ amd $\beta_1$ with said line wherein $\alpha$ equals $\alpha_1$ and $\beta$ equals $\beta_1$.

6. In a device for forming a splice between a moving web from a finishing roll of material being delivered to a processing machine and an overlapping portion of a new web from a new roll of material, said device comprising acceleration means to adjust the circumferential speed of the new roll to the linear speed of the moving web of the finishing roll; detection means for detecting an overlapping splicing area previously prepared on the new roll; pressure means for pressing the moving web against the outer surface of the new roll when the splicing area on the outer surface of the new roll passes by the pressure means; and cutting means for cutting the moving web being unwound from the finishing roll after formation of the splice with the new web of the new roll, the improvements comprising a support having a pair of spaced side members, a first axle being mounted for rotation in said side members, a first idler roller mounted for rotation on said first axle between the side members; said acceleration means including an acceleration arm assembly having a first frame with one end having a second transverse axle and the other end being mounted for rotation on said first axle between the side members of the support, a subassembly being mounted at one end for movement on said second axle and having a roller axle with an acceleration roller keyed thereto at the opposite end, means for rotating the subassembly on said second axle, means disposed on the frame for rotating the acceleration roller, and means for rotating the acceleration arm assembly on said first axle; pressure means including a pressure arm assembly having a second frame having one end rigidly connected to said first axle on the outside of the side members to rotate therewith, said second frame supporting a third axle and a fourth axle with the fourth axle at the end and the third axle being spaced inward of said fourth axle, said third and fourth axles each extending across said second frame, a pair of short levers pivotally mounted on the third axle and rotatably supporting a pressure roller at one end, means rotating the short lever arms on the third axle, means connected to the first axle for rotating the first axle in the side member with the second frame moving therewith, and the fourth axle rotatably supporting a tension roller; and said cutting means including two knives mounted on a blade support, said blade support being mounted for pivotal movement on said fourth axle, and means connected to the blade support and the second frame for rotating said cutting means on said fourth axle.

7. In a device according to claim 6, wherein the means for rotating the subassembly on said second axle includes a pinion gear secured to the subassembly and mounted on said second axle for rotation, a pneumatic piston having a piston rod mounting a rack gear engaged with said pinion, said piston being secured to the frame of the acceleration arm assembly, said rack gear and pinion shifting the subassembly between a retracted position enabling the frame of the acceleration arm assembly to pass through the frame of the pressure arm assembly toward a second position with the acceleration roll engaging the circumferential surface of the new roll.

8. In a device according to claim 6, wherein the means for rotating the acceleration roller include a motor connected to a first tooth pulley being mounted on the first frame, a second tooth pulley connected to a first pinion gear, a tooth belt extending between said tooth pulleys and a second gear keyed to the roller axle in meshing engagement with the first pinion.

9. In a device according to claim 6, wherein said means for rotating the cutting means rotates the cutting means in one direction for cutting during an "IN" splicing mode and in the opposite direction during an "OUT" splicing mode so that a different knife is used for each mode.

* * * * *